US007682033B2

(12) United States Patent
Cranor

(10) Patent No.: US 7,682,033 B2
(45) Date of Patent: Mar. 23, 2010

(54) POLYGONAL CHEMILUMINESCENT LIGHTING DEVICE

(75) Inventor: Earl Cranor, Longmeadow, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 0 days.

(21) Appl. No.: 11/751,499

(22) Filed: May 21, 2007

(65) Prior Publication Data

US 2008/0291658 A1 Nov. 27, 2008

(51) Int. Cl.
*F21K 2/00* (2006.01)
*F21V 9/16* (2006.01)
*F21V 3/00* (2006.01)

(52) U.S. Cl. ..... 362/34; 362/84; 362/311.15

(58) Field of Classification Search ..... 362/34, 362/84, 311, 339; 252/700; D26/37; D10/114
See application file for complete search history.

(56) References Cited

U.S. PATENT DOCUMENTS

| | | | | | |
|---|---|---|---|---|---|
| 5,043,851 | A | | 8/1991 | Kaplan | |
| D356,276 | S | * | 3/1995 | Liu et al. | D10/114 |
| 5,971,570 | A | * | 10/1999 | Simon | 362/336 |
| 5,980,055 | A | * | 11/1999 | Palmer et al. | 362/34 |
| 6,033,092 | A | * | 3/2000 | Simon | 362/298 |
| 6,106,129 | A | * | 8/2000 | Cranor et al. | 362/34 |
| 6,991,452 | B1 | * | 1/2006 | Semaan | 431/291 |

* cited by examiner

*Primary Examiner*—Jong-Suk (James) Lee
*Assistant Examiner*—David R Crowe
(74) *Attorney, Agent, or Firm*—McHale & Slavin, P.A.

(57) ABSTRACT

A chemiluminescent illuminated device employing a light-filtering injection molded polygonal shaped container that is scalloped to form an augmented illumination surface. The shaped housing includes a round shaped or form following chemical holding section. The lighting effects generated by the chemiluminescent chemical is enhanced by the polygonal shape and the inherent optical properties.

12 Claims, 1 Drawing Sheet

POLYGONAL CHEMILUMINESCENT LIGHTING DEVICE

FIELD OF THE INVENTION

This invention is directed to the field of chemiluminescent lighting devices and, in particular, to the shaping of chemiluminescent vessels for purposes of enhancing illumination without increasing chemical levels.

BACKGROUND OF THE INVENTION

Chemiluminescent devices are non-incandescent products which produce light from a chemical mixture. The basic chemiluminescent process produces light when two chemical solutions are combined. The solutions are kept physically separated prior to activation. Physical separation typically consists of a sealed frangible glass vial containing a first solution that is placed within a second solution, both of which are housed in a sealed flexible vessel. When the vessel is flexed, the glass vial is ruptured thereby releasing the vial solution wherein the admixed chemical creates a reaction that produces light.

The chemical solutions are generally referred to as the "oxalate" component and the "activator" component. A typical oxalate component consists of Dibutyl Phthalate, CPPO and CBPEA.

A typical activator solution contains Dimethyl Phthalate, T-butyl alcohol, 90% aq. Hydrogen Peroxide, Sodium Salicylate. The components may be separated by a vial, pellet, separating wall, and so forth. Despite the type of separation, the object of these devices is to produce usable light. For this reason, the outer vessel is made of a light-filtering plastic material which permits the light produced by the reaction to pass through the vessel walls.

Numerous patents exist that disclose improvements in the oxalate and activators, such patents extending or enhancing the illumination properties of chemiluminescent lighting devices. The unique lighting effects generated from chemiluminescent lighting devices are enhanced by the inherent optical properties of the containing vessel. The color, clarity and degree of effervescence, if any, serve to add to dissipation of light throughout the vessel wall. Some dyes or coloring agents can be used not only as color filters but as fluorescers. A fluorescent dye functions by converting light of one wavelength to another wavelength. For example, blue light from a chemiluminescent device might be converted to red light by employing an appropriate fluorescer. This red light could be produced even if there was little or no red light emitted by the chemiluminescent device. Most of these improvements strive for producing a brighter illumination of the device. If the vessel is actually made larger, the amount of chemical needed is increased thereby making the device uneconomical. The corners, as disclosed, act as light concentrators to give an enhanced lighting effect but is commercially unviable. Conventional chemical lighting devices are manufactured with polyethylene or polypropylene plastics. Other types of plastics such as vinyl's, acrylics, or such are not compatible with the solvents typically utilized by chemical lighting devices.

U.S. Pat. No. 5,043,851 shaped housing having distinct corners that concentrate light. The light concentration creates a fiber optic display-like effect which enhances the visibility of radiated light by concentrating the chemiluminescent light at each corner. The physical act of forming the polyethylene or polypropylene plastic containers described by U.S. Pat. No. 5,043,851 via extrusion or injection molding creates stress lines at the corners needed for the fiber optic effect.

Additionally, the chemical light reaction forms, as a by-product, carbon dioxide gas. A normal chemical light device develops an internal pressure of as much as 50 psig internal pressure within 30 minutes of initiation of the chemical light reaction. Consumers will use chemical lighting devices under all weather conditions. Polyolefins that remain flexible at low temperatures (35 F) start to soften and loose physical properties at higher temperatures (140 F). It is very common for a consumer to store a chemical light device in the trunk of their automobile for possible roadside emergencies. A dark vehicle in bright sunlight can have a temperature within the trunk of over 160 F. A consumer activating a chemical light device manufactured per U.S. Pat. No. 5,043,851 and subjected to high temperatures would experience product failure, the stress lines resulting in the splitting and leaking of the container.

What is lacking in the art is a chemiluminescent device that enhances the illumination properties of chemiluminescent devices while reducing the weight, cost and rigidity of the device by altering the shape of the vessels.

SUMMARY OF THE INVENTION

The instant invention is a polygonal shaped vessel for containing of the "oxalate" and "activator" component. The shaped vessel permits the distribution of light in a controlled manner so as to allow for augmented illumination of the shape of the device without increasing the amount of chemical required. The vessels can be constructed from translucent polyethylene or polypropylene having a polygonal shape that enhances the light illuminating properties. The illuminated devices employ chemiluminescent means as lighting sources and may have four or more outer sides with either a form following or round shaped chemical holding section.

The shaped vessel of the instant invention may also include internal geometry which similarly provides a lighting device that appears larger than a conventional tubular shaped vessel without an increase in chemical usage. The vessel modifications, both internal or external, allow for the reduction in the amount of plastic yet allow for the increase in the apparent size of the vessel, as ascertainable by the human eye. The reduction in plastic reduces the manufacturing costs and reduces the rigidity of such vessels. The reduction in plastic allows for an increase in flexibility thereby permitting new and unique vessel shapes and sizes. The use of injected mold followed by scalloping of the side walls prevents stress cracks otherwise found in the prior devices.

The lighting effect generated by the chemiluminescent chemical is enhanced by the shape of the vessel which may have indicia placed thereon to further enhance the inherent optical properties of the vessel.

Accordingly, it is an objective of the instant invention to disclose the use of a polygonal shaped vessel for purposes of enhancing the distributing of chemiluminescent light without the need for additional chemical reagents.

It is a still another objective of this invention to teach the modification of the external geometry of chemiluminescent light vessels to provide a lighting device that appears significantly larger than a conventional chemiluminescent tubular shaped type vessel.

Another objective of this invention is to disclose how various modifications to chemiluminescent light vessels produce a new, unique, surprising and unexpected effect that creates visually enlarged chemiluminescent light devices ascertainable by the human eye.

Other objectives and advantages of this invention will become apparent from the following descriptions taken in conjunction with the accompanying drawings wherein set forth, by way of illustration and example, are certain embodiments of this invention. The drawings constitute a part of this specification and include exemplary embodiments of the present invention and illustrate various objects and features thereof.

DETAILED DISCLOSURE OF THE PREFERRED EMBODIMENTS

Figure 1:
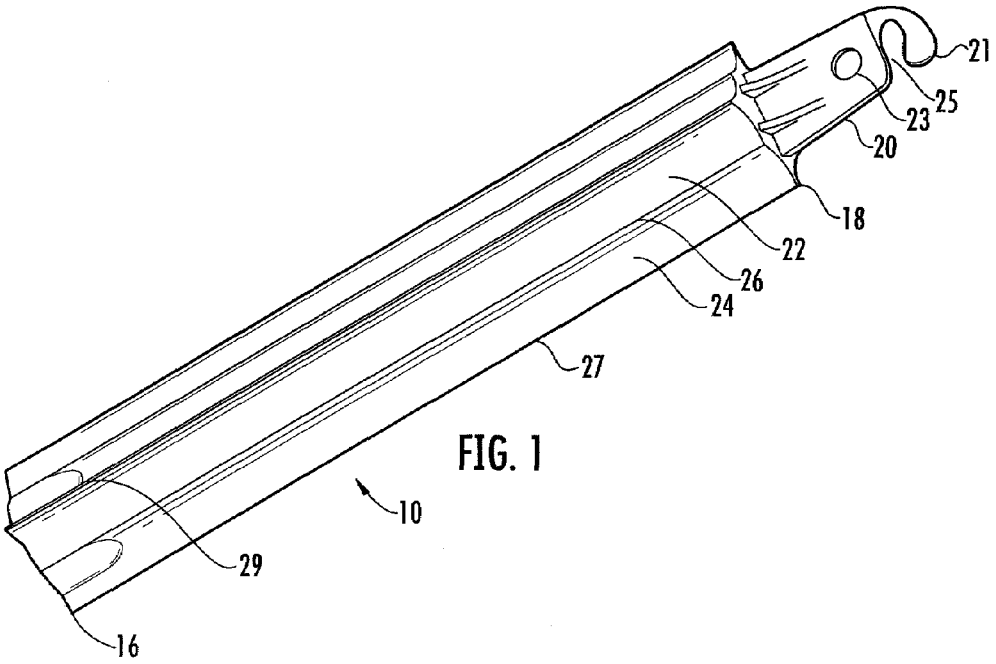
FIG. 1 is a perspective view of a polygonal embodiment of the instant invention.
Figure 2:
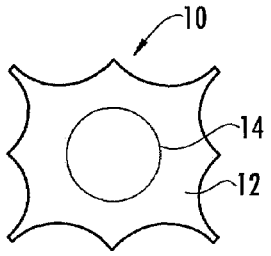
FIG. 2 is a cross sectional end view of FIG. 1.

Although the invention is described in various specific embodiments, it will be readily apparent to those skilled in this art that various modifications, rearrangements and substitutions can be made without departing from the spirit of the invention. The scope of the invention is defined by the claims appended hereto. With reference to FIGS. 1 and 2, set forth is an injection molded rectangular shaped housing 10 having a square shaped cross section 14 and tubular inner annulus 14. In the preferred embodiment, the outer dimensions of the housing 10 are 1 inch by 1 inch by six inches long. The inner tubular annulus 14 has a diameter of about 0.5 inches and a length of 5.85 inches extending from one end 16 of the device and almost all the way through the device to the second end 18. A projection 20 may extend outwardly for use in coupling to a lanyard or the like. The projection includes a hook shaped member 21 defining an eye 23 and an open side 25 for admitting a horizontal support member.

The box shaped vessel has an inner cavity 14 running from one end 16 through its center almost all the way to the second end 18. Further modify the exterior of device by scalloping each side of the long flat plane resulting in an inward curvature 22 and 24 and a peak 26 in the center of each long flat plane. In this manner, the final device retains the general physical structure of a rectangle with a square cross section but ends up with twice as many fiber optic "corners" as described by U.S. Pat. No. 5,043,851. Further, due to both the circular cross section of the inner annulus plus the plastic mass extending from the inner annulus to each corner, the final device resists physical failure at extreme temperatures.

Figure 3:
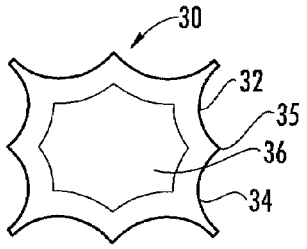
FIG. 3 is a cross sectional end view of a polygonal embodiment with a form following chemical chamber.

FIG. 3 is a cross sectional end view illustrating the scalloping of each side plane resulting in an inward curvature 32 and 34 and a peak 35 in the center of each plane. In this embodiment, a form following shaped chemical holding section 36 allows for the holding of additional chemical and enhanced lamination to the raised points by lessening of the light transfer.

In manufacturing of the polygonal chemiluminescent device, injection molding the plastic into a light-filtering container having four side walls and an inner cavity sized to support chemiluminescent reagents constitutes a first step. The side walls are then scalloped to form intersecting corners; an intersection corner of a scallop may be at each side wall corner or preferably between two scallops 22 & 24 as shown by the raised ridge 26. Reagents are inserted into the inner cavity 14 and sealed therein. Activation of the chemiluminescent reagents produces chemiluminescent light providing enhanced lighting at the intersecting corners 26, 27 & 29 from a given amount of said reagents. For ease of illustration, the intersecting corners are numbered on one side of the container, however, enhanced lighting occurs at each of the intersecting corners for each side wall. In the preferred embodiment, each side wall is about 1 inch wide and the intersecting corner is defined at each edge 27 and 29 of the side wall and between each edge 26 of said side wall.

Figure 4:
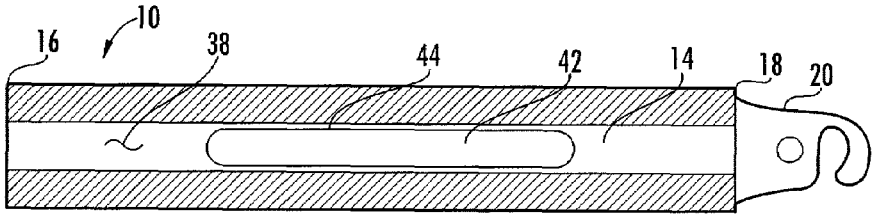
FIG. 4 is a cross sectional side view of a light stick.

The improved chemiluminescent device of the instant invention is a flexible, light-filtering injection molded container having an inner cavity which forms a chemical holding section which is sized to support chemiluminescent reagents and an outer shape that forms an augmented illumination surface which enhances the distribution of light from a given amount of the chemiluminescent reagents. FIG. 4 depicts a first reagent 38 is placed into the chemical holding section 14. A second reagent 42, which is contained in a frangible ampoule 44, is also inserted into the chemical holding section 14, and the container 10 is sealed. Manipulation of the flexible container so as to cause rupture of the frangible ampoule allows the two reagents to admix, whereby the reaction of said chemiluminescent reagents produces a chemically produced light. The chemical holding section has approximately the same volume as prior art chemiluminescent light sticks. However, the use of any of the instantly described outer shapes creates a larger outer dimension than the conventional products. When light is transmitted throughout this larger outer shape, the entire periphery of the container is illuminated. This provides enhanced illumination, and a device that appears significantly larger while utilizing the same amount of said reagents. This unique enlargement is possible without increasing the amount of chemical used as the vessel provides directional aspects to radiated light so that the outer most edge of the vessel, despite the edge shape, provides to the human eye the perception that the vessel size is equally and uniformly enlarged.

The outer shape of the vessel can also allow for a reduction in plastic yet create to the human eye the perception that the vessel size is enlarged without increasing the amount of chemical. The internal cavity may be varied, as embodied by the above mentioned external shapes, and provide similar visual results. The reduction in the amount of plastic allows enlarged light devices to be formed in diameters greater than 0.400 inches which is impractical with conventional light devices due to plastic rigidity. The inner cavity may also include a proliferation of ridges, prongs or extensions that extend inwardly from the vessel wall which provide directional transfer of radiated light.

Indicia, not shown, may be used to alter light diffusion to further enhance vessel illumination. For instance, the surface of the material may include a prismatic shape stamped or molded into the material which further operates to optimize available light and provides diffusion through the indicia. If the light is colored, the indicia provides shadows for highlighting of the indicia. In addition, depending on the container material and the type of chemiluminescent chemical employed, the indicia provides an alteration of the spectral light which can further allow the indicia to illuminate in a color distinctive of the remainder of the lighting device. Similarly, the placement of opaque indicia on an available flat portion of a formed container, allows the chemiluminescent light to provide a background for highlighting of the indicia.

It is to be understood that while we have illustrated and described certain forms of the invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A method of manufacturing a polygonal chemiluminescent device comprising the steps of:

injection molding a light-filtering container having an inner cavity having a center and sized to support chemiluminescent reagents and an outer shape, said outer shape having a generally rectangular cross section and a plurality of side walls at a distance from said center which intersect to form side wall corners;

forming a plurality of scalloped surfaces within each of said side walls, each of said scalloped surfaces including an inwardly directed curved surface that merges with an adjacent scalloped surface to form said side wall corners and intermediate intersecting corners within each of said side walls, wherein the distance from the center of said inner cavity to the tips of said side wall corners is greater than the distance from said center of said inner cavity to the tips of said intermediate intersecting corners;

inserting reagents into and sealing said inner cavity;

whereby activation of said chemiluminescent reagents produces chemiluminescent light providing enhanced lighting at said side wall corners and said intermediate intersecting corners from a given amount of said reagents.

2. The method according to claim 1 wherein each said side wall is about 1 inch wide and is scalloped to provide an intersecting corner at each edge of said side wall and between each edge of said side wall.

3. The method according to claim 1 including the step of sealing one of said reagents in a sealed frangible ampoule.

4. The method according to claim 1 including the step of forming a projection at one end of said device having an aperture for use in supporting the device.

5. The method device according to claim 1 including the step of forming a projection at one end of said device having a hook shaped member defining an eye and an open side for admitting a horizontal support member.

6. A chemiluminescent device comprising: chemiluminescent reagents, a light-filtering thermoformed container having an inner cavity having a center and sized to support said chemiluminescent reagents and an outer shape having a generally rectangular cross section and having a plurality of side walls at a distance from said center which intersect to form side wall corners, each of said side walls including a plurality of inwardly directed curved surfaces which merge with adjacent curved surfaces to form said side wall corners and intermediate intersecting corners within each of said side walls, wherein the distance from the center of said inner cavity to the tips of said side wall corners is greater than the distance from said center of said inner cavity to the tips of said intermediate intersecting corners; whereby the activation of said chemiluminescent reagents produces chemiluminescent light which when transmitted throughout said outer shape provides enhanced lighting at said side wall corners and said intermediate intersecting corners from a given amount of said reagents.

7. The device according to claim 6 wherein said side walls are about 1 inch wide.

8. The device according to claim 6 including a projection located at one end having an aperture for use in supporting the device.

9. The device according to claim 6 including a hook shaped member defining an eye and an open side for admitting a horizontal support member.

10. The device according to claim 6 wherein said inner cavity is round.

11. The device according to claim 6 wherein said inner cavity is formed to follow said outer shape.

12. The device according to claim 6 wherein one of said reagents is in a sealed frangible ampoule.

* * * * *